US005776003A

United States Patent [19]

Kenny

[11] Patent Number: 5,776,003

[45] Date of Patent: Jul. 7, 1998

[54] JUMPING TOY

[76] Inventor: Trevor Lindsey Kenny, 39 Penfold Crescent, Winnipeg, Manitoba, Canada, R2J 1S3

[21] Appl. No.: 735,584

[22] Filed: Oct. 23, 1996

[51] Int. Cl.[6] ..... A63G 13/04

[52] U.S. Cl. ..... 472/135; 472/105

[58] Field of Search ..... 472/135, 95, 103, 472/104, 105; 482/34, 35, 36, 27

[56] References Cited

U.S. PATENT DOCUMENTS 2,978,243 4/1961 Gabrielson ..... 472/135 X
3,494,613 2/1970 Hatfield ..... 472/135 X
3,716,229 2/1973 Van Der Cleyen et al. .
3,785,642 1/1974 Sterlicchi .
4,438,919 3/1984 Gamzo .
4,893,809 1/1990 Blankenzee .

*Primary Examiner*—Kien T. Nguyen
*Attorney, Agent, or Firm*—Adrian D. Battison; Murray E. Thrift

[57] ABSTRACT

A recreational apparatus for use in jumping or bouncing above a planar surface is described. The recreational apparatus comprises a rigid annular platform with foot supports connected by a plurality of springs of sufficient strength to support a person engaged in jumping or bouncing to a core element that has a planar base.

13 Claims, 3 Drawing Sheets

JUMPING TOY

The present invention relates to a recreational apparatus for use in jumping or bouncing.

BACKGROUND OF THE INVENTION

Ideally, a recreational apparatus should be durable, relatively safe and easy to use while still providing maximal enjoyment. While there are several recreational apparatuses known in the art for use by a single user for jumping or bouncing, these do not meet all of the above criteria.

For example, U.S. Pat. No. 4,438,919 teaches a bouncing, rolling and skating recreational apparatus for multiple users. Also disclosed in this patent is a smaller version of the apparatus for a single user. This smaller apparatus comprises a wheeled base connected to an annular platform by guide rods which are surrounded by helical springs. These springs cause the apparatus to bounce while rolling or skating. The annular platform also contains foot supports and surrounds a balloon or ball that is inflated so as to serve as support means during rolling or bouncing. The inventor also notes that this inflated ball can be used as a flotation device. Obviously, the safety of this apparatus is somewhat questionable, due to the fact that it will bounce while rolling, thereby making it difficult to control.

U.S. Pat. No. 3,785,642 teaches a sealed, partially inflated, flexible ball equipped with hand holds that is divided internally into two separate compartments. In operation, the user places their feet on opposite sides of the ball while seated on the ball, grips the hand holds, and shifts their weight from side to side, thereby simulating a jogging motion. This device is not mobile; rather, it is designed for use solely upon its designated base.

U.S. Pat. Nos. 3,716,229 and 4,893,809 teach of a jumping toy comprising an inflatable ball body of an elastic material and an associated rigid annular plate that surrounds the ball body. During operation, the feet of the user engage foot supports on the rigid annular plate and the user jumps upward. At the end of the jumping motion, the resilient ball body contacts the ground, and bounces. However, the ball body is not of sufficient elasticity to provide as much elevation as desired by some users. This is further compounded by the fact that the pressure in the ball body will decrease as a result of use over time, thereby further decreasing the maximum attainable elevation.

SUMMARY OF THE INVENTION

It is one object of the invention, therefore, to provide a recreational apparatus for bouncing above a substantially planar surface.

According to a first aspect of the invention, there is provided a recreational apparatus comprising:

- a core member having a first end and a second end, said first end for contacting the ground;
- a rigid annular platform surrounding the core member, said rigid annular platform having foot supports for gripping contact with feet of a person on said supports;
- a plurality of springs;
- means for attaching a first end of the springs to the core member; and
- means for attaching a second end of the springs to the rigid annular platform, wherein the springs are of sufficient strength to support the person positioned upon the rigid annular platform when engaged in resilient movements such as bouncing or jumping.

Preferably, the core member is a cylinder with a substantially planar base. By having a planar base, the area contacting the ground during bouncing is maximized.

A plurality of flexible connection members extend radially from the core member to positions along the lower face of the rigid annular platform and function as restraining means, thereby preventing excessive tilting of the rigid annular platform relative to the core member during bouncing.

The springs extend radially from the second end of the core member to the rigid annular platform. The springs are attached to the core member at a first position and the springs are attached to the rigid annular platform at a second position such that the first position is above the second position.

The core member is further characterized by an absence of wheels and by not extending significantly beyond the rigid annular platform. Thus, the invention is not designed for rolling or skating, nor does it include a support handle.

The foot supports comprise an annular flange connected to the upper face of the rigid annular platform.

The use of coiled springs in the recreational apparatus rather than an inflated ball represents an improvement in that the coiled springs are more resilient and will not deflate over time.

DETAILED DESCRIPTION

Figure 1:
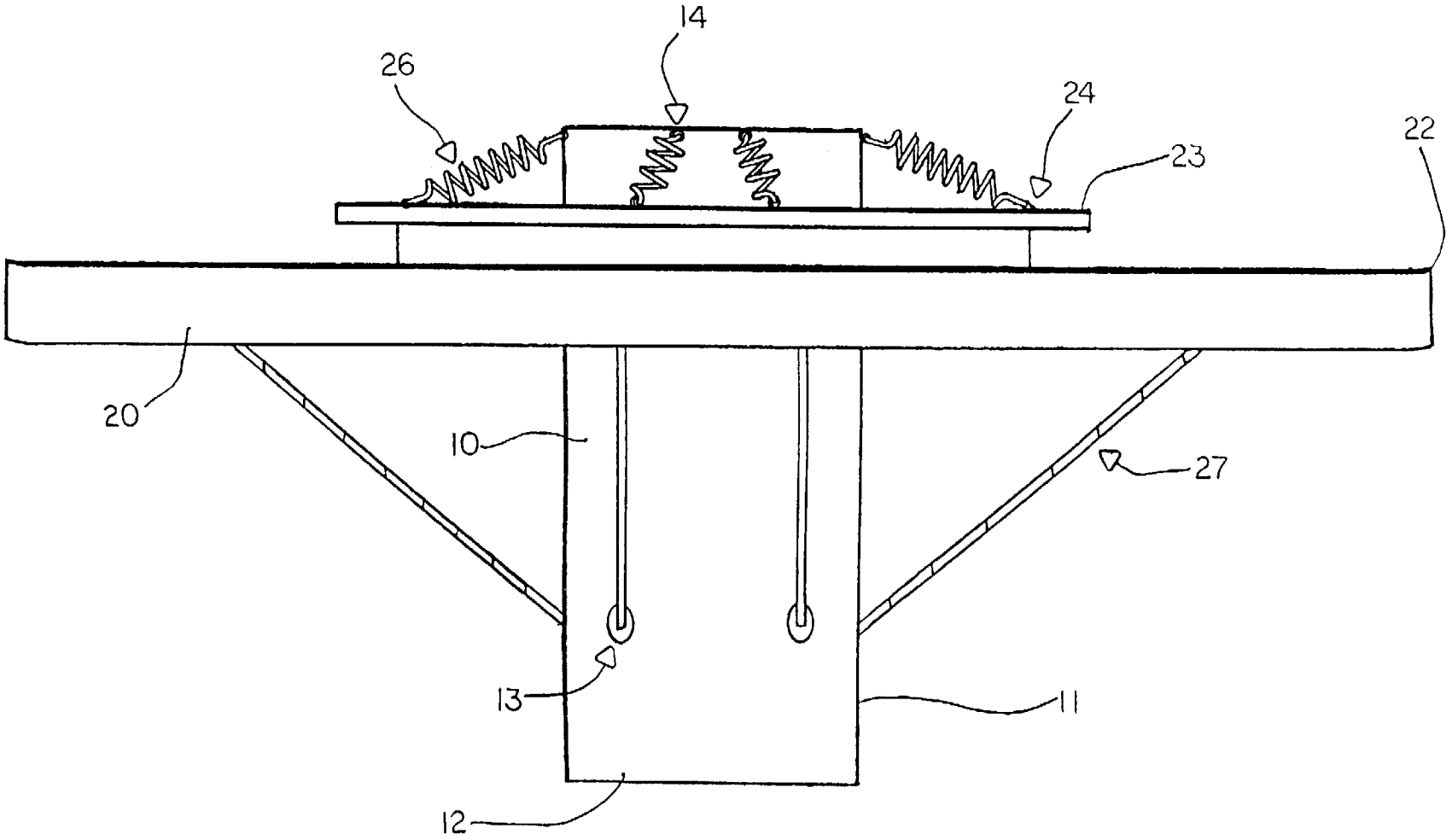
FIG. 1 is a side elevational view of the recreational apparatus.
Figure 2:
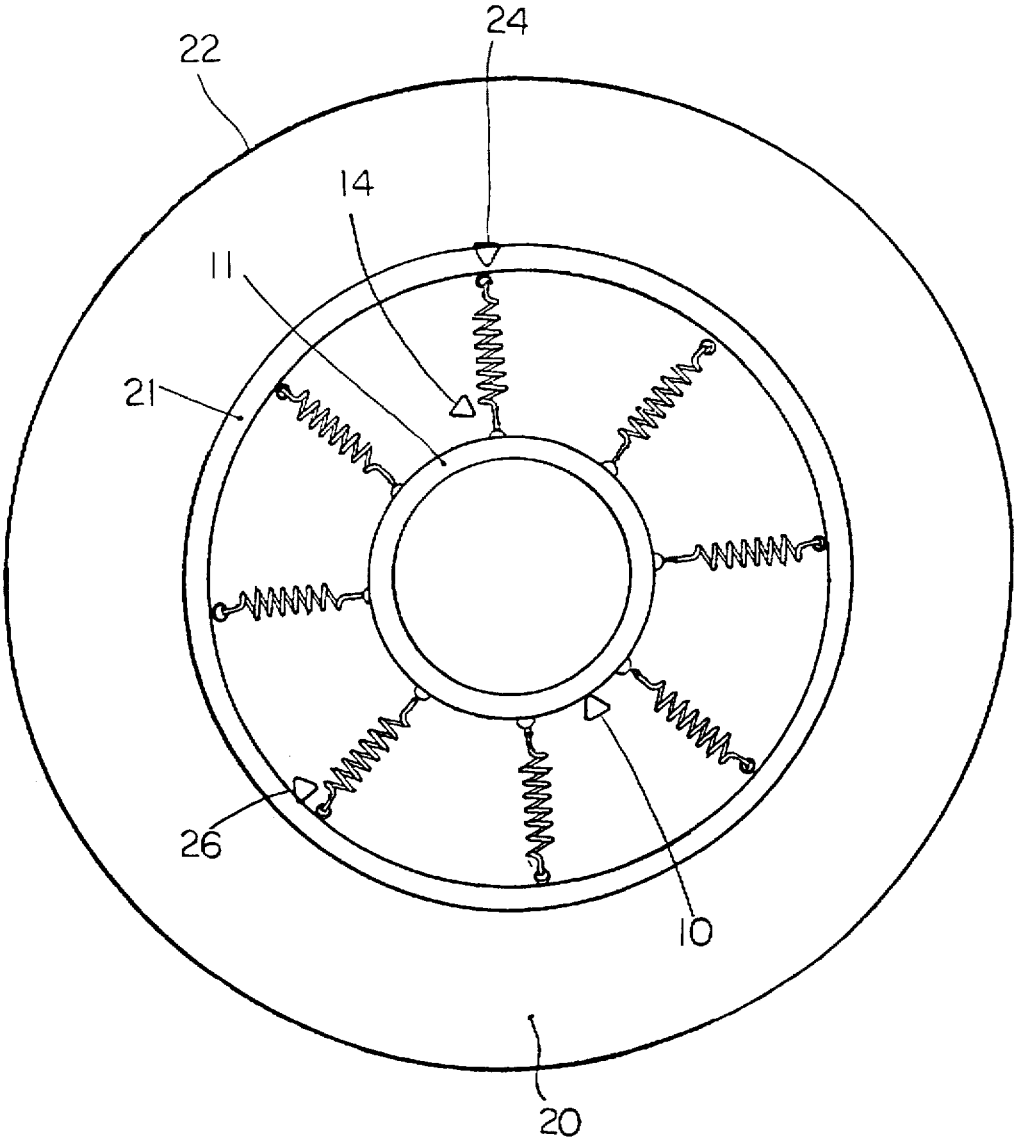
FIG. 2 is a top plan view of the recreational apparatus.
Figure 3:
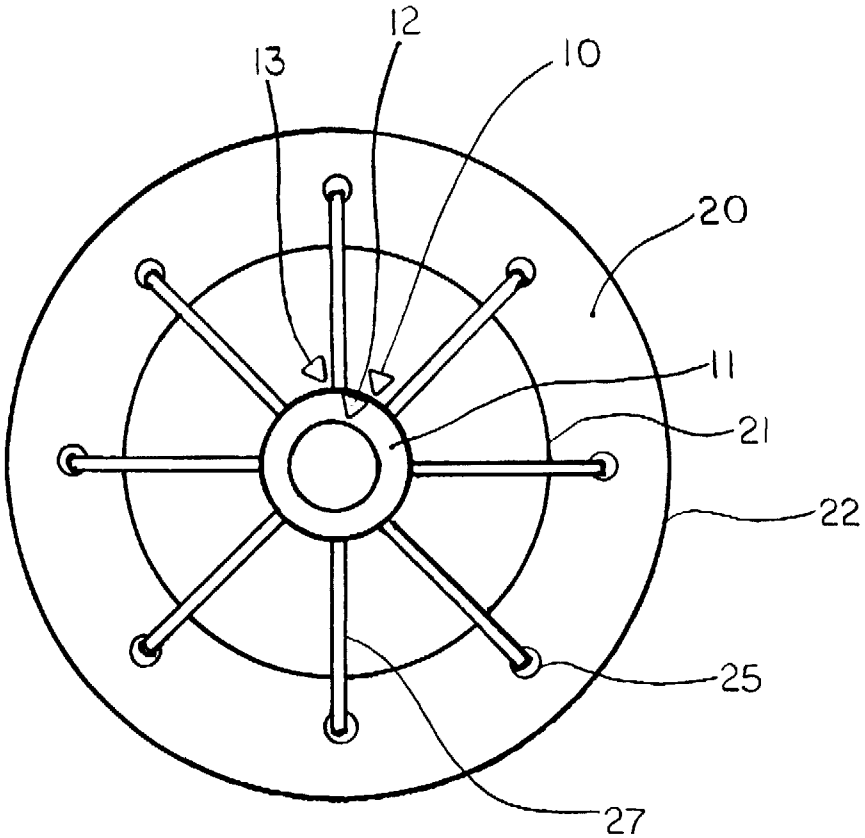
FIG. 3 is a bottom plan view of the recreational apparatus.

In one embodiment, the invention comprises a core element 10 and a rigid annular platform 20 as shown in FIGS. 1–3.

The core element 10 comprises a hollow cylinder 11. The fact that the cylinder is hollow makes the apparatus more aerodynamic during operation. The hollow cylinder 11 has a substantially planar base 12 for contacting the ground. Immediately above the base are connecting means 13 for attaching guide strings as described below. The guide string connecting means 13 are evenly spaced annularly around the outside of the hollow cylinder 11 as shown in FIG. 1. At the top of the hollow cylinder 11 are a series of apertures 14 for connecting the hollow cylinder 11 to the coiled springs, as described below and shown in FIG. 1. The coiled spring apertures 14 are evenly spaced annularly around the outside of the hollow cylinder 11. Of note is that the core member 10 is not wheeled and does not include a support handle.

The rigid annular platform 20 is of sufficient strength to support the weight of the user when engaged in jumping or bouncing. The rigid annular platform 20 has an inner ring 21 and an outer ring 22. The inner ring 21 is elevated above the upper face of the rigid annular platform 20. Surrounding the inner ring of the rigid annular platform is an elevated flange 23 that is gripped by the feet of the user during operation. Along the inner face of the inner ring 21 are connecting means for attaching the coiled springs 24 as described below. The coiled springs connecting means 24 are evenly spaced annularly around the inside face of the inner ring 21. Additionally, there is a plurality of connecting means 25 spaced evenly around the middle of the lower face of the rigid annular platform 20 as shown in FIG. 3. These connecting means 25 are for the attachment of the guide strings during assembly of the recreational apparatus as described below.

The recreational apparatus is assembled as follows. Coiled springs 26 are attached at one end to each of the coiled spring apertures 14 evenly spaced annularly around the top of the hollow cylinder 11 as shown in FIGS. 1 and 2. The opposite ends of the coiled springs 26 are attached to the inner ring 21 of the rigid annular platform 20 at the coiled spring connecting means 24 described above. Thus, the rigid annular platform 20 surrounds the core element 10, and the rigid annular platform 20 and the core element 10 are connected by a plurality of coiled springs 26. In this configuration, the attachment points of the coiled springs to the core element 14 are above the attachment points of the coiled springs to the inner face of the inner ring of the rigid annular platform 24. Thus, the top of the core element 10 is above the plane of the rigid annular platform 20. Of note is that the coiled springs 26 are of sufficient strength to support the weight of the user while the user is engaged in jumping or bouncing. In addition, guide strings 27 are connected at one end to the guide string connecting means along the base of the core element 13 and at the other end to the guide string connecting means located along the lower face of the rigid annular platform 25 as shown in FIGS. 1 and 3. The guide strings 27 provide additional means for interconnecting the core element 10 and the rigid annular platform 20, and serve to prevent excessive tilting of the rigid annular platform 20 during operation.

In operation, the planar base 11 of the recreational apparatus is placed on a flat surface. Next, the user places their feet on the upper face of the rigid annular platform 20 such that gripping contact is established between the feet of the user and the annular flange 21. By maintaining this gripping contact while jumping, the user lifts the recreational apparatus off the flat surface. When the flat planar base 11 contacts the flat surface at the end of the jumping motion, the force of impact and the weight of the user on the rigid annular platform 20 are transferred to the coiled springs 26, thereby causing the coiled springs 26 to extend. However, the resiliency of the coiled springs 26 causes the coiled springs to recoil, which provides force for subsequent jumping action. This occurs immediately as the process is repeated. During this process, the guide strings 27 prevent excessive tilting of the rigid annular platform 20 relative to the core element 10.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. Recreational apparatus comprising:

a rigid cylindrical core member having a vertical axis and defining a first lower end and a second upper end, the first lower end being arranged for directly contacting the ground;

a rigid horizontal annular platform surrounding the axis of the core member and moveable in a direction along the axis relative to the core member, said rigid annular platform having foot engagement means thereon for gripping contact with feet of a person standing on said platform;

at least one spring having a first end of the spring attached to the core member and a second end of the spring attached to the rigid annular platform, wherein the at least one spring is of sufficient strength to support the person standing upon the rigid annular platform and provide resilient suspension for bouncing movements in said direction.

2. The recreational apparatus according to claim 1 wherein the first end of the core member is substantially planar.

3. The recreational apparatus according to claim 1 including restraining means for preventing tilting of the rigid annular platform relative to the core member during said bouncing movements.

4. The recreational apparatus according to claim 3 wherein the rigid annular platform has a lower face and the restraining means comprises a plurality of flexible connection members extending radially from the core member to positions on the lower face of the rigid annular platform.

5. The recreational apparatus according to claim 1 wherein said at least one spring comprises a plurality of individual springs extending radially from the core member to the rigid annular platform.

6. The recreational apparatus according to claim 5 wherein the springs are attached to the core member at a first position and the springs are attached to the rigid annular platform at a second position such that the first position is above the second position.

7. The recreational apparatus according to claim 1 wherein the foot engagement means comprises an annular flange parallel to and spaced upwardly from the upper face of the rigid annular platform, the flange facing outwardly from the axis for gripping by inward movement of the feet of the person.

8. Recreational apparatus comprising:

a rigid core member having a vertical axis and defining a first lower end and a second upper end, the first lower end being arranged for directly contacting the ground;

a rigid horizontal annular platform surrounding the axis of the core member and moveable in a direction along the axis relative to the core member, said rigid annular platform having foot engagement means thereon for gripping contact with feet of a person standing on said platform;

at least one spring having a first end of the spring attached to the core member and a second end of the spring attached to the rigid annular platform, wherein the at least one spring is of sufficient strength to support the person standing upon the rigid annular platform and provide resilient suspension for bouncing movements in said direction;

and wherein the foot engagement means comprises a rigid annular flange parallel to and spaced upwardly from the upper face of the rigid annular platform, the flange facing outwardly from the axis for gripping by inward movement of the feet of the person.

9. The recreational apparatus according to claim 8 wherein the first end of the core member is substantially planar.

10. The recreational apparatus according to claim 8 including restraining means for preventing tilting of the rigid annular platform relative to the core member during said bouncing movements.

11. The recreational apparatus according to claim 10 wherein the rigid annular platform has a lower face and the restraining means comprises a plurality of flexible connection members extending radially from the core member to positions on the lower face of the rigid annular platform.

12. The recreational apparatus according to claim 8 wherein said at least one spring comprises a plurality of individual springs extending radially from the core member to the rigid annular platform.

13. The recreational apparatus according to claim 12 wherein the springs are attached to the core member at a first position and the springs are attached to the rigid annular platform at a second position such that the first position is above the second position.

* * * * *